United States Patent [19]

Walker et al.

[11] 4,231,209

[45] Nov. 4, 1980

[54] SELF-SYNCHRONIZING BOTTLE CARRIER APPLICATOR

[75] Inventors: Maurice Walker; Buren R. Wheeley, both of Memphis, Tenn.; Charles A. Glass, Horn Lake, Miss.

[73] Assignee: Royal Crown Cola Company, Atlanta, Ga.

[21] Appl. No.: 56,383

[22] Filed: Jul. 10, 1979

[51] Int. Cl.[3] ..... B65B 21/02

[52] U.S. Cl. ..... 53/48; 53/314; 53/556

[58] Field of Search ..... 53/48, 313, 314, 315, 53/316, 556

[56] References Cited

U.S. PATENT DOCUMENTS

| | | | |
|---|---|---|---|
| 3,826,060 | 7/1974 | Vergobbi | 53/48 |
| 3,867,807 | 2/1975 | Doucette | 53/48 |
| 3,877,196 | 4/1975 | Vergobbi | 53/48 X |
| 3,877,198 | 4/1975 | Vergobbi | 53/48 |

*Primary Examiner*—Horace M. Culver

*Attorney, Agent, or Firm*—Sughrue, Rothwell, Mion, Zinn and Macpeak

[57] ABSTRACT

An endless horizontal conveyor discharges cartons of necked bottles onto a horizontal tabletop aligned with the endless conveyor insuring carton-to-carton movement of the bottles beneath the discharge end of a gravity chute feeding a series of bottle carriers, individually supplied to the gravity chute from a nested carrier stack onto bottles. The carriers are pulled onto the bottles by movement of the cartons and the bottles carried thereby. A keeper plate adjacent the discharge end of the gravity chute and downstream therefrom insures contact between the tops of the leading end bottles in each carton and the leading end of the carrier. Movement of the carton-contained bottles pulls the carriers from the chute and deposits the carriers in proper position overlying the tops of the bottles to form six-pack or eight-pack groups. An applicator wheel downstream of the chute discharge area for the carrier presses the carriers downwardly to force the bottle tops to penetrate through given holes into the carriers corresponding to the bottle position to cause the carriers to frictionally grip the bottle necks below the bottle caps. No positive drive synchronization is required for the carton conveyor, the means for feeding the carriers from the stack within the hopper to the gravity chute or the applicator wheel for pressing the carrier downwardly onto the bottle necks.

10 Claims, 9 Drawing Figures

FIG. 2
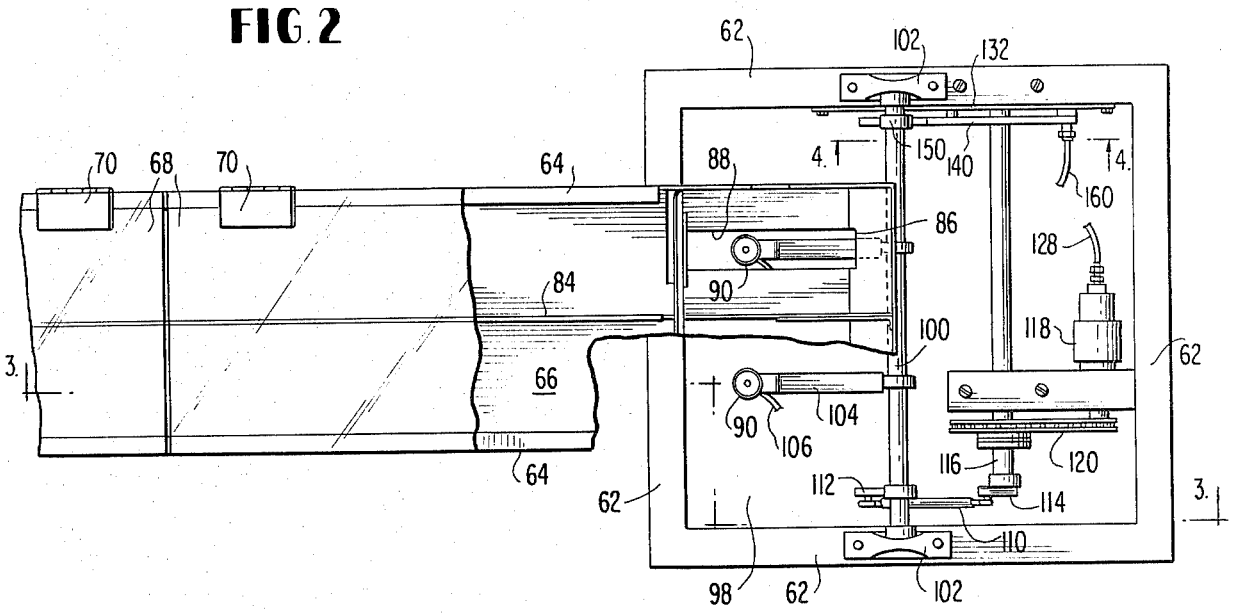
FIG. 4
FIG. 3
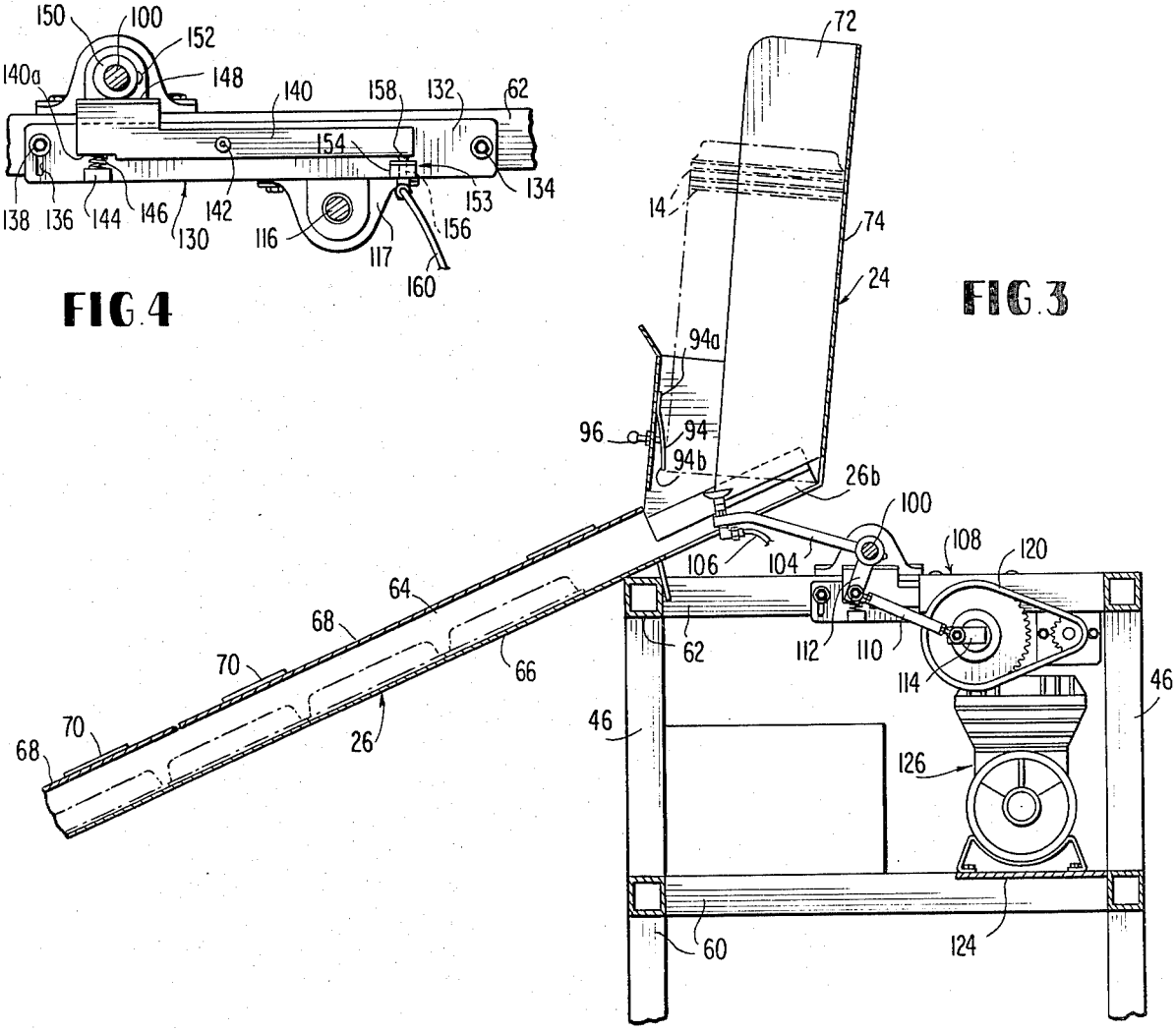

SELF-SYNCHRONIZING BOTTLE CARRIER APPLICATOR

FIELD OF THE INVENTION

This invention relates to automoated machines for supplying molded plastic six-pack or eight-pack carriers to upstanding necked containers such as bottles, to form a carrying assembly for hand transport of the carriers with the bottles held by their necks after the molded plastic article is pressed over the bottle caps. More particularly, the present invention is directed to a machine or apparatus which functions automatically and without the necessity for complex and intricate synchronizing means to assure proper positioning and assembly of the carriers relative to the individual bottles.

BACKGROUND OF THE INVENTION

In current use today to facilitate packaging and transport of a plurality of containers such as bottles, cans and the like, are molded plastic container carriers of modified sheet form which bear a plurality of openings through which portions of the bottles or can protrude such that they are frictionally gripped. In the case of bottles, the carriers are provided with spaced holes or openings generally sized to the necks of the bottles and being stretched or otherwise deformed locally to permit the carriers to move downward onto the bottlenecks such that the bottle caps and the upper portions of the necks protrude through the holes with carrier portions at the necks frictionally gripping the bottles beneath the enlarged caps.

Various machines or production apparatus have been devised for automatically effecting the assembly of the carriers to a grouped number of bottles to form an easily transportable, hand carried package. One such machine forms the subject matter of U.S. Pat. No. 3,967,807 to Eugene F. Doucette issuing Feb. 25, 1975. The applicator machine of that patent is highly complex and fully automated, requiring synchronous movement of many different parts. A plurality of stacks of nested carriers are arranged on a turret. The turret is rotated to place the individual stacks, one at a time as needed directly overlying a hopper. The nested stacks are then released into the hopper where they are frictionally maintained and prevented from discharging through the bottom of the hopper. A plurality of worm gears constitute drive mechanisms to pull off the carriers, one at a time in a continuous fashion, and drop them onto an inclined carrier delivery conveyor belt. A gating mechanism at the bottom, exit end of the conveyor belt holds the carriers in a position such that its lead end extends downstream of the conveyor and in the path of movement of the tops of the bottle containers as they are transported on a horizontally oriented endless conveyor mechanism. The bottle containers are brought to a first assembly station by means of a container conveyor belt, and, at that station, the containers come into contact with a first pair of star wheels. The star wheels are positioned on opposite sides of the conveyor belt and operate to position the containers substantially perfectly so as to fit the indentations on the carriers. The exit end of the carrier conveyor is also at this assembly station such that, as the bottles move along the conveyor, the tops of the bottles grab the front end of the carrier presently at the exit of the carrier conveyor and pull the entire carrier out of the gate, whereby it is properly fitted to the tops of six or eight bottles, depending upon whether the machine is arranged for forming six-packs or eight-packs.

Thereafter, the containers with the carrier riding on the tops of the bottles pass to a final assembly station, which includes an applicator wheel. The application wheel is provided with indentations on its periphery at positions corresponding to the tops of the containers which pass beneath the wheel which is rotated about a horizontal axis and which overlies the containers and the carrier. The wheel is pivotably mounted and biased downwardly so as not to crush the bottles in case there is misregistration between the indented portions of the application wheel and the tops of the containers.

A second pair of star wheels insure alignment of the bottle containers at the final assembly station with the indented portions of the application wheel. The star wheels are positioned just below and slightly in advance of the application wheel. As the bottles carrying the carrier pass beneath the application wheel, the wheel forces the carrier downwardly, and the bottle tops are projected through small diameter openings within the carrier, such that the carrier grips the necks of the bottles just below the bottle caps.

While the machine of the referred to patent operates adequately to place the molded carrier onto the multiple bottles to create carrying packages in six-pack or eight-pack form, the machine is highly complicated due to the necessity for synchronously moving the bottles and the carrier and for insuring that synchronism, once initiated, continues throughout the various stations of the machine.

It is therefore a primary object of the present invention to provide an improved simplified and low cost carrier applicator for bottle containers, in which there is no necessity to synchronously drive the bottles, the carrier or the applicator wheel, and in which any synchronization to effect container and carrier assembly is achieved by the components themselves.

SUMMARY OF THE INVENTION

The present invention comprises an improvement in a machine which forcibly applies the series of molded plastic carriers having rows of aligned holes therein onto a series of upright container bottle moving along a horizontal bottle path. The machine includes a hopper which supports at least one stack of carriers above the bottle path and means for removing in serial fashion the carriers from the bottom of the stack and feeding them along a corresponding carrier path leading from the carrier stack towards the underlying bottle movement path and intersecting the same. The movement of the bottles causes the tops of the bottles to pull the carriers over and across the tops of the bottles passing thereunder. An applicator wheel is mounted for rotation about a horizontal axis, positioned above the bottles and the carrier and downstream of the intersection of the carrier and bottle paths. Means are provided for forcibly applying the wheel into peripheral contact with the carriers to press the carriers onto the bottles to the extent that the bottle tops project through the holes to form six-pack or eight-pack assemblies.

The improvement resides in employing a gravity chute which is longitudinally aligned with the bottle path and is inclinded downwardly and away from the at least one carrier stack and terminates in an open discharge end just above the top of the bottle moving along the bottle path. The bottle path is formed by a horizontal powered conveyor means positioned beneath the chute with its discharge end terminating upstream of the discharge end of the gravity chute and having a table whose top is aligned with the horizontal powered conveyor means and which extends downstream therefrom from the discharge end of the horizontal powered conveyor means to a point underlying the applicator wheel. Further, individual open top cartons of predetermined size carry a predetermined number of upright bottles in row and column positions within the cartons corresponding to the position and spacing of the holes within the carriers such that regardless of random movement of the cartons of bottles along the horizontal bottle path as determined by the horizontal powered conveyor means, the cartons are moved over the table beneath the discharge end of the chute and to the applicator wheel in end to end contact solely by the force of cartons discharging onto the table top from the powered conveyor means, such that carriers are always in proper alignment with the upright bottles. Thus, multi-bottle carrier packs are readily assembled with the carrier portions encircling the bottle necks and with the carriers embracing a selected group of container bottles.

The applicator wheel preferably comprises a hollow drum having an open peripheral network including circumferentially spaced members contacting portions of the carriers on opposite sides of given carrier holes. These members may comprise a plurality of transversely extending parallel rods joined to respective discs at opposite ends and forming said open network. Further, longitudinally spaced rubber bands may resiliently encircle the plurality of rods and be laterally spaced in conformance to the rows of holes on the carriers to effect pressing contact by the drum on the carriers at both longitudinal and lateral opposed sides of the carrier holes.

At least one taper plate may be fixedly cantilever mounted adjacent to the discharge end of the gravity chute and extend at a slight downward inclination in the direction of movement of the carriers, the bottles and the cartons with the taper plate having a leading end positioned above the carriers and a trailing end in slight pressing contact with the leading end of the carriers as they discharge onto the top of the bottles to facilitate proper disposition of the carriers onto the bottles. Preferably, the hopper includes transverse side by side duplicate carrier stacking compartments, a pair of oscillating vacuum cups selectively subjected to vacuum pressure are movable into and out of the carrier stack compartments and forcibly remove the lowermost carriers from the stack and place onto the chute bottom wall to form a series of end to end abutting carriers gravity fed to the discharge end of the chute. A cam operated vacuum pressure relief operatively driven by the shaft bearing the vacuum cup arms acts to interrupt the application of vacuum pressure to the vacuum cups at the moment the cups move the lowermost carriers of the stack into contact with the supply end of the chute to assure the serial feed of carriers to the area of intersection of the carrier path and the bottle path.

BRIEF DESCRIPTION OF THE DRAWINGS

FIG. 2 is a top plan view of a portion of the machine of FIG. 1, showing the carrier hopper and the carrier gravity chute.

FIG. 3 is an enlarged, vertical sectional view of a portion of the machine shown in FIG. 2 taken about line 3—3, as seen from the side opposite that of FIG. 1.

FIG. 4 is a vertical sectional view of a portion of the machine shown in FIG. 2 taken about line 4—4.

DESCRIPTION OF THE PREFERRED EMBODIMENT

Figure 9:
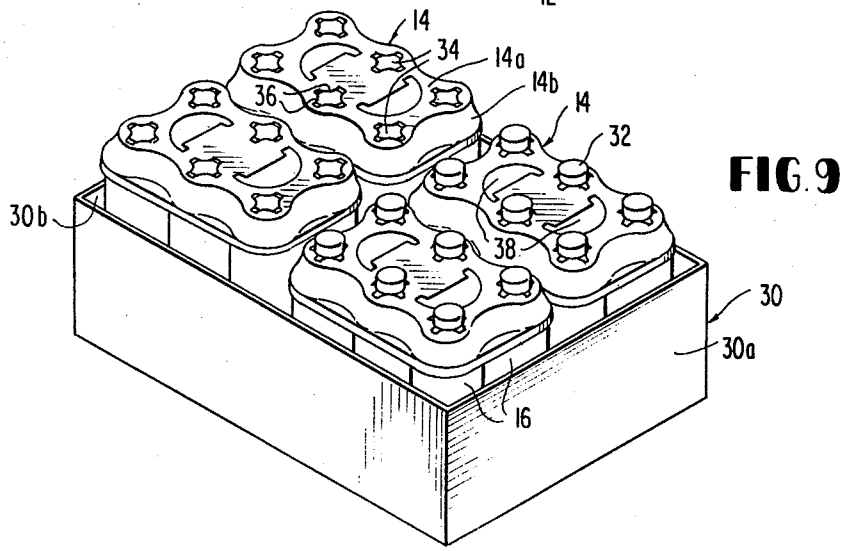
FIG. 9 is a perspective view of a carton of 24 bottle containers in four six-pack groups bearing carriers with the forward two of the carriers pressed onto the necks of the bottles by the applicator wheel.

Referring to the drawings, there is shown generally at 10 an applicator machine or apparatus forming a preferred embodiment of the present invention, the machine functioning to dispense six or eight-pack bottle carriers 14 from a stack and apply the carriers 14 to bottles 16 carried within open top cartons 30 and with the carriers and bottles moving along intersecting paths. The machine indicated at 10 comprises, in terms of major parts, a frame indicated generally at 12 including a table 18 with the top 18*a* of the table being aligned with the upper run of an endless conveyor belt 22, at its discharge end 22*a*. The belt 22 is driven by a suitable drive mechanism indicated generally at 20. A hopper 24 is frame mounted at the rear of the machine and is integral at its lower end with an inclined, carrier gravity chute 26 whose discharge end 26*a* overlies and is somewhat spaced vertically from the top 18*a* of table 18. At the discharge end of the table 18, remote from belt 22 there is provided an applicator wheel 28 which functions to press the individual carriers 14 downward over the tops of the bottles 16 at this point in the movement of the bottles which are confined within cartons 30. The bottles 16 are borne in the individual cartons 30 as best seen in FIG. 9, the carton 30 moving from left to right in FIG. 1 on the upper run of the conveyor belt 22 and discharging onto the front end of table 18. As indicated in FIG. 9, each carton 30 is of standard size, being open at its top and bearing twenty-four bottles in this case. This permits the creation of four six-packs by applying four carriers 14 to the bottles 16. In that respect the bottles 16 are aligned four abreast in six longitudinal rows from the front end 30*a* of the carton to the rear end 30*b* of that carton. The bottles 16 are provided with closures or caps as at 32 and the bottles 16 and are of the necked variety including necks 16*a* which threadably or otherwise bear the caps 32. The carriers 14, which are illustrative only of one form which these articles can take, are of molded plastic sheet material including a flat center portion as at 14*a* and an integral tapered skirt 14*b* about the complete periphery. The flat central portion 14*a* is perforated as at 34 in two laterally spaced, longitudinal rows of three holes each, the holes taking a form of star cut outs defining radially inwardly projecting lips 36 which are spaced diametrically from each other a distance which is smaller than the diameter of the bottle caps 32. Thus, the lips 36 are deformed when the carriers are pressed downwardly to the extent that the caps 32 borne by the necks 16*a* project through the holes 34. This is seen in FIG. 9 as the transition from the position shown for the carriers 14 with respect to the last three transverse rows of bottles in contrast to the first three adjacent the leading end 30*a* of the carton 30. Further, hand gripping holes 38 may be provided within the carrier to assist lifting of each completed carrier and bottle assembly or carrying package for removal from the carton.

Figure 1:
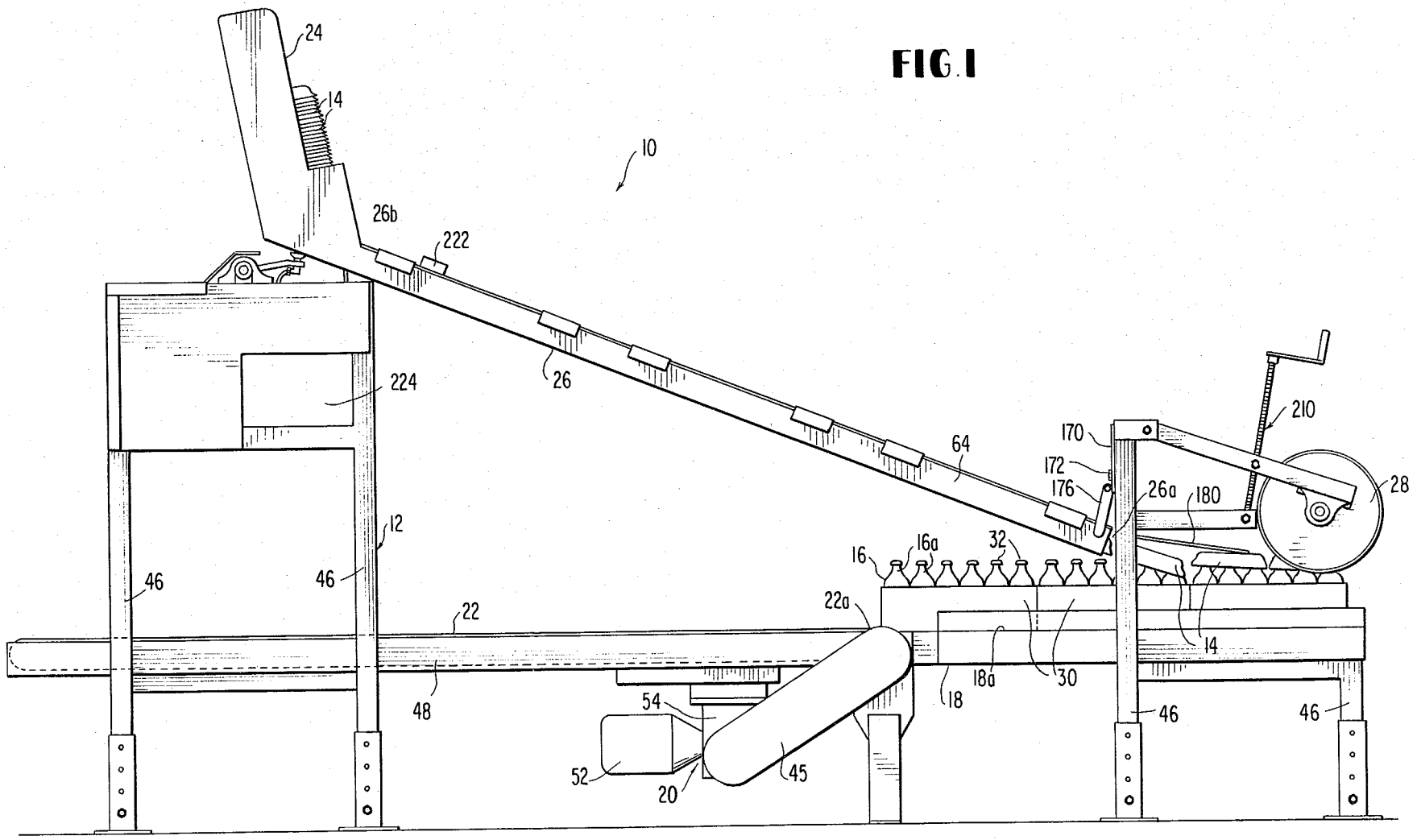
FIG. 1 is a side elevational view of a simplified self-synchronizing bottle applicator machine of the present invention forming one embodiment of the present invention.
Figure 5:
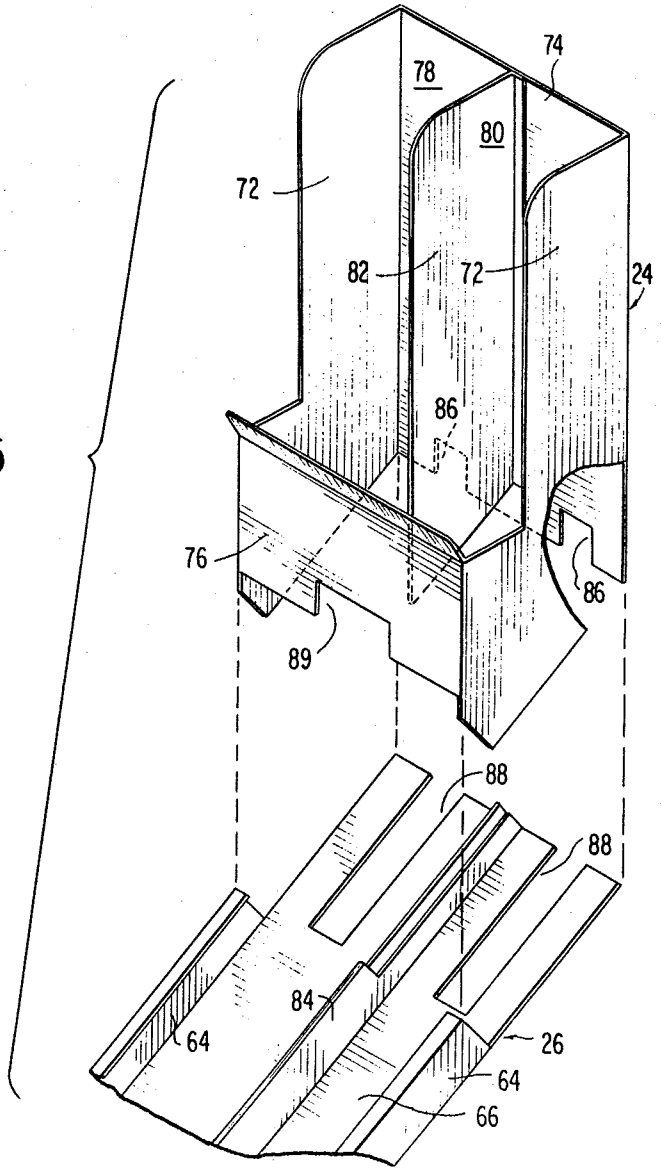
FIG. 5 is an exploded perspective view of the carrier hopper and the supply end of the carrier gravity chute of the machine of FIG. 1.
Figure 6:
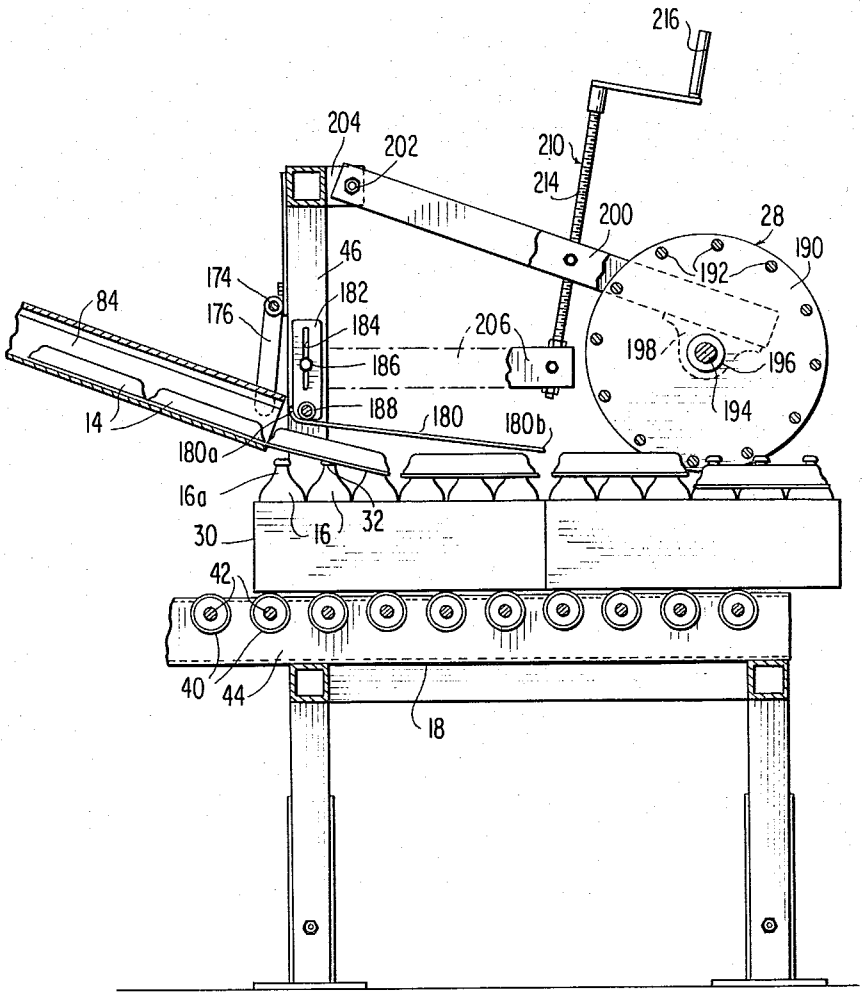
FIG. 6 is an enlarged, side elevational view of a portion of the machine shown in FIG. 8, partially in section and partially broken away.

An important aspect of the present invention is the utilization of the endless conveyor belt 22 and the cartons 30 for advancing the bottles to the carrier applying station at the right hand end of the machine, FIG. 1. Further, it is additionally important to note that the endless conveyor belt 22 does not extend the full length of the machine but terminates at some distance upstream of the discharge end 26*a* of the carrier gravity chute 26. In that respect, as seen in FIG. 6, the table 18 bears a plurality of elongated rollers 40 which rotate about axles 42 which axels span between laterally opposed C beams 44 to define the table top 18*a*. The cartons 30 bearing the bottles 16 are thus caused to move by force application, from one carton to another, created by the cartons 30 discharging from the right hand end 22*a* of the conveyor belt 22. Regardless of how the cartons 30 are spaced on the endless conveyor belt 22, the dead space created by the termination of the endless conveyor belt 22 upstream of the discharge end 26*a* of the gravity chute insures that the cartons 30 downstream of the conveyor belt 22 will be in abutment with each other, and therefore not only will the cartons 30 be aligned, but the aligned bottles carried by the cartons 30, correspond to the end to end abutting line of carriers 14 being fed to the area of intersection of the bottle and carrier paths.

Frame 12 is made up of a series of laterally spaced columns 46 which, in addition to support table 18 at the right hand end at the front of the machine. Certain of the multiple columns 46 are connected to longitudinal beams 48 to form a framework to support the endless conveyor belt 22 for rotation in a clockwise direction, FIG. 1. Cartons 30 which are loaded onto the rear of the machine, that is, at the left, FIG. 1, onto the top run of the conveyor belt 22, move towards the discharge end 22*a* of the belt 26 adjacent table 18. The conveyor drive mechanism 20 comprises a conveyor drive motor 52, a transmission mechanism 54, and chain drive element 45, all supported by the frame 12. This assembly drives the conveyor belt 22 at a desired speed. There is no necessity to correlate the speed of the conveyor belt 22 to any of the other driven elements of the machine. The columns 46 at the rear of the machine act to support at a vertical height well above table 18, the hopper 24 and the supply end of the gravity chute 26. In that respect, frame 12 includes a set of first horizontal beams or bars 60, FIG. 3, intermediate of the conveyor belt 22 and the upper ends of left end columns 46, and second set of horizontal beams or bars 62 at the extreme upper ends of those columns 46. These members define a support platform for the components associated with the hopper and the upper end of the gravity chute 26. The frame members as well as the other major components of the machine may be formed of metal and may be welded to each each other to form a rigid assembly. The chute 26 is formed of sheet metal including laterally opposed sidewalls as at 64 an integral bottom wall 66 and bears a plurality of doors as at 68 hinged to one of the sidewalls 64 by suitable hinges as at 70, FIG. 2. This permits access to the interior of the chute 26 should the individual carriers as at 14 become stuck and fail to slide by gravity down the upper surface of bottom wall 66 as seen in FIG. 3.

Further, the hopper 24 is integrally joined to the upper end 26*b* of the chute 26. The sheet metal hopper includes oppposed vertical sidewalls 72, a rear wall 74 which spans therebetween and a front wall 76 of reduced height. Further, the hopper 24 acts to support two stacks of carriers 14 within individual stacking compartments as at 78 and 80, the compartments being separated by a central vertical separating wall 82. The bottom of the hopper 24 opens to the bottom wall 66 of the gravity chute 26. Further, there is provided a vertical separating wall 82 within the chute 26 and which extends the full length of the same so as to maintain separate carrier paths for the carriers 14 as they slide down chute 26 after being dispensed from respective carrier stacks within hopper compartments 78 and 80. The sidewalls 72 of the hopper 24 are of generally modified L-shaped configuration and being wider at the bottom than they are at the top. Further, the rear wall 74 bears rectangular openings or slots as at 86 for each compartment which are aligned with elongated rectangular openings or slots 88 within the bottom wall 66 of the chute 26. The purpose of these openings is to permit a pair of suction cups as at 90, FIG. 3, to penetrate into respective compartments interiors and to contact the bottom of the lowermost carriers 14 of respective stacks and to pull the lowermost carriers downwardly to a position where they contact the bottom wall 66 of the chute. The suction is terminated for cups 90 and the cups are separated from the carriers. The carriers 14 are permitted to slide by gravity down the chute in two separate parallel rows, end to end, for the discharge serially at the discharge end 26*a* of the gravity chute. The front wall 76 of the hopper bears a rectangular opening 89 within its lower end to permit access to the interior of the cute at this point should the need arise.

The carriers in nested fashion form two separate stacks within respective compartments 78 and 80 as seen in FIG. 3, with one edge of the lowermost carrier 14 contacting the upper end of the bottom wall 66 of the conveyor chute 26, FIG. 3. The carriers in nested fashion are frictionally restrained and prevented from falling onto the bottom wall 66 of the conveyor by means of spring friction plates 94 forming a portion basket tension adjustors 95, the spring friction plates being fixed at their upper ends as at 94*a* to the rear of hopper front wall 76.

The spring friction members 94 are cantilevered with their free ends 94*b* pressed against the edges of the stacked carriers, at the bottom of the stack, which face the front wall 76 of the hopper. Sufficient frictional force is maintained to prevent inadvertent gravity drop. Adjustment screws 96 are screws threaded to the front wall 76 and project therethrough so that by rotating the screws, the spring friction plates 94 are compressed to a greater degree against the edge of lowermost carriers of the stacks when the two stacks are loaded in the manner of FIG. 3.

As noted previously, the supply end 26*b* of the chute overlies a rectangular opening 98 defined by the transversely spaced bars or beams 62, FIG. 2. A shaft 100 straddles, transversely, opposed beams 62 and is mounted for rotation about its axis by means of bearing blocks 102 at each end. The blocks 102 are fixed to opposite bars or beams 62 and the shaft 100 is thus rotatable about its axis. Vacuum cup arms 104 are fixed to the shaft 100 at longitudinally spaced positions aligned with openings 88 and 86. The arms bear at their outboard ends the vacuum cups 90 to which vacuum pressure is selectively supplied by way of tubing or hose 106. A crank mechanism indicated generally at 108 includes a link 110 attached at one end to a short length crank arm 112 fixed to shaft 100 and at its other end to a second crank arm 114. Crank arm 114 is fixed to and projects radially from one end of shaft 116. Rotation of shaft 116 about its axis, cause the oscillation of the vacuum cup arms 104 between position wherein the vacuum cups 90 contact the lowermost carriers 14 to a position where the lowermost carriers are transferred into full surface contact with the bottom wall 66 of chute 26 adjacent its upper end.

Shaft 116 is supported appropriately by paired bearing blocks 117, beneath the transverse frame bars or beams 62, the bearing blocks 117 being mounted on one of the beams 62 and a short length beam 62*a*, respectively. The shaft 116 is driven by means of an air drive motor 118 which is mounted to the short length beam 62*a*. It drives the shaft 116 through a chain and sprocket drive mechanism 120. Mounted to a plate 124 supported in turn by the intermediate beams or bars 60 of the frame member 12 is a combined air compressor and vacuum pump indicated at 126. This is the source of vacuum pressure for the paired vacuum cups 90 through their supply lines 106. Further, positive air pressure from the combined compressor/vacuum pump 126 is supplied to the air motor 118 through its supply line 128. Lines 106 which lead from the vacuum source portion of the compressor/vacuum pump unit 126 normally permit vacuum pressure to exist at all times within the vacuum cups 90. However, to effect the timed release of the carriers from the stacks within compartments 78 and 80 of the hopper 24, there is provided a vacuum release mechanism indicated generally 130. This mechanism is best seen in FIG. 4. The mechanism consists of a metal strip 132 of rectangular configuration being pivotably mounted to bar 62 at one end as by way of screw 134. The opposite end, which extends just beyond shaft 100, carries an elongated slot 136 at right angles to its longitudinal axis, through which passes an adjustment screw 138, screw 138 being screwed into bar 62 and acting to lock the strip 132 in a desired angular orientation with respect to bar 62 and at a predetermined distance from the axis of rotation of shaft 100. The strip 132 bears a rocker arm as at 140 which is pivoted near its center by way of a screw 142. A blocker 144 mounted to the side of strip 132 bears a compression spring 146 on one face thereof, the compression spring 146 abutting the lower surface 140 of the rocker arm 140 beneath shaft 100. A portion 148 of the upper surface of the rocker arm 140 acts as a cam follower face and is in contact with the periphery of a cam 150 carried by the shaft 100 and being rotatable therewith. A cam radial protrusion 152 is borne by the cam at one circumferential position, and the cam 150 is mounted relative to the shaft 100 such that during the oscillation of the vacuum cup arms 104, at a predetermined angular position of those arm 104 and the cups 90 carried thereby, as for instance when the cups 90 pass downward to the point where they are just above or in line with the openings 88 within the bottom wall 66 of the chute 26, the radial projection 152 of cam 150 presses on the cam follower face 148 of the rocker arm 140 to cause the rocker arm, FIG. 4 to pivot counterclockwise. A vacuum relief valve indicated generally at 153 is mounted beneath the right end of the rocker arm 140, the valve comprising a valve body 154 bearing an air passage 156 which is normally closed off by a movable valve member 158 which acts to seat upon the open end of the passage 156 within the valve body 154. A vacuum line 160 leads to the valve body 154 from the vacuum pressure side of the compressor/vacuum pump unit 126. Momentarily when the rocker arm 140 is rotated counterclockwise against the bias of the compression spring 146, the movable valve member 158 moves away from the valve such to release the vacuum pressure within line 160 from the source which is also common to the vacuum cups via their lines 106.

From the above, it may be seen, therefore, that manually stacks of carriers 14 are provided within the respective compartments 70 and 80 of the hopper 24. The lowermost carriers 14 are prevented from dropping out of the hopper onto the upper end of the chute 26. However, the vacuum pressure applied by way of cups 90 overcomes the frictional restraint provided by the tension or frictional force exerted on the edges of the carrier and permits the applied suction force to pull off the lowermost carriers 14 and deposit them on the upper face of the bottom wall 66 of the chute, with vacuum cut off occurring at the moment of contact of the bottom wall of the chute by the lowermost carrier of each of the stacks, by way of the vacuum release valve 153.

Figure 8:
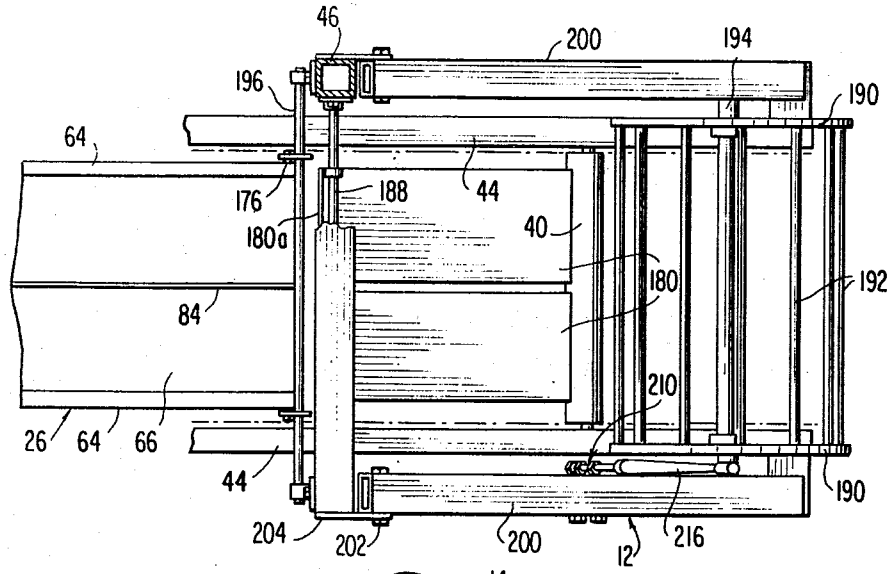
FIG. 8 is an enlarged, top plan view of the portion of the machine shown in FIG. 1 bearing the applicator wheel.
Figure 7:
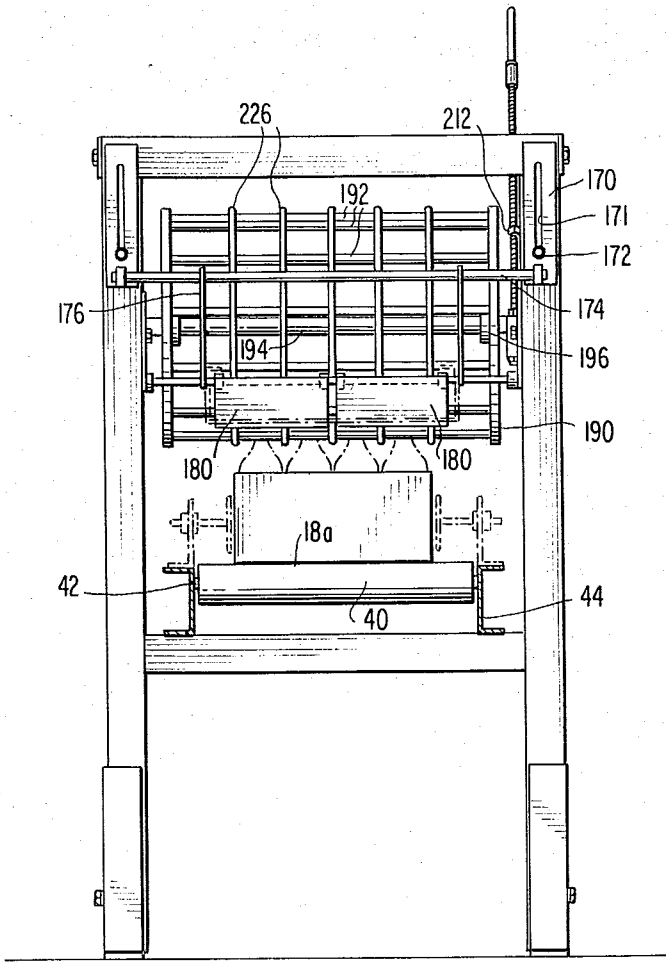
FIG. 7 is a front elevational view of the machine of FIG. 1.

Turning next particularly to FIGS. 6, 7 and 8, the make up of right hand end or front of the machine, FIG. 1, and the operation of the elements carried thereby may be readily appreciated. As cartons 30 of bottles 26 pass under the discharge end 26*a* of the gravity chute 26, the bottles 16 tend to pull in succeeding order the carriers 14 from the cute 26 on each side of the vertical divider wall 84 of that chute. Proper vertical height of the discharge end 26*a* of the chute 26 is important. Also adjustment of that height may be required, depending upon the height of the bottle containers 16 to be packaged. In that respect, the frame column members 46 adjacent the discharge end 26*a* of the chute 26 bear on opposite sides of the machine vertical adjustment strips 170, these strips 170 being slotted longitudinally at 171 through which slot 171 project adjustment screws 172 for each of the strips permitting the strips to be raised or lowered and fixed at adjustable vertical positions on the columns 46. The strips 170 bear between them a transverse shaft or rod 174. The rod 174 in turn bears arms 176 which are pivotably attached, at their lower ends, to respective opposed sidewalls 64 of the chute 26. Thus, the discharge end 26*a* of the chute 26 may be raised or lowered and locked at a vertical adjustable position to insure that the carrier properly fall onto the bottles 16 when the top of the leading bottle catches the skirt of the projecting portion of the carrier 14.

Further, to insure that a single carrier is gravity deposited on the tops of the bottles 16, there is provided keeper plates 180 which are cantilever mounted and being slightly inclined to the horizontal. They are fixed between the vertical columns 46 at the discharge end 16*a* of the chute 26, just downstream from the point of discharge. The plates 180 extend from and are fixed via a transverse rod 188 to paired vertical adjusting strips 182 which include elongated slots at 184 and through which pass adjustment screws 186. The plates 182 are carried on the inside walls of given columns 46 on opposite sides of the machine. There are individual keeper plates 180 for each of the two flow paths for the carriers 14 lying on opposite sides of the vertical dividing wall 84 of chute 26. The inclined plates 180 terminate in curved ends 180*a* which are fixed to transverse shaft 188 which is coupled at its ends to the opposed adjustment strips 182. The screws 186 which are threaded to the vertical columns 46 on opposite sides may be loosened and the keeper plates 180 may be adjusted vertically so that the leading edge 180*b* is above the top of the carrier 14 as it exits from chute 26. The trailing edge 180*b* should be located in the path of carrier 14 to apply light pressure to the carriers 14 at the point where they pass beneath the edge of this member. This insures that only one carrier 14 is placed on the bottles 16 at a time and holds the carriers in place when they are on the bottles as they move into contact with the applicator wheel 28 downstream from the trailing edge 180*b*.

The applicator wheel 28 takes the form of a hollow drum consisting of laterally opposed discs 190 being joined at the disc periphery by parallel circumferentially spaced rods as at 192. The ends of the rods 192 pass through drilled holes or the like within discs 190. The rods form an open peripheral network. The wheel 28 is mounted for rotation about its axis by means of a shaft 194 which projects through sleeve bearings 196 which are borne by bearing blocks 198 fixed on the outboard ends of a pair of applicator wheel support arms 200. Each arm 200 is pivotably mounted at its inboard end to given columns 46 at their upper ends, FIGS. 6, 7. Bolts 202 project through the arms 200 and mounting plates 204 which may be welded to the sides of the columns 46 and which project horizontally outwardly therefrom and at right angles thereto.

Further, to one side of the machine, there is further fixed a lower beam as at 206 which is welded at one end to a given column 46 and which projects horizontally at right angles to the axis of the column 46 parallel one of the plates 204 and generally in line therewith. At the end of the bars 206 remote from the column 46 to which they are attached, the bar 206 supports a sleeve or cylinder 208 which rotatably carries one end of a wheel height adjustment rod 210, the rods 210 bearing a threaded nut 212 which is fixed as by welding, to the side of respective bars 200, the wheel height adjustment rod being threaded throughout its length as at 214 and being threaded to the nut 212. The end of the wheel height adjustment rod 210, opposite the sleeve 208 bears a handle as at 216 such that by rotation of the wheel height adjustment rod handle, the rod 210 coupled to one of the bars or arms 200, the applicator wheel 28 is raised or lowered, the arm 200 pivoting about the axes of bolt 202. Axel 194 may be spring mounted to beam 200 to permit axel shift under compressive force to prevent damage to the carriers by contact of wheel periphery.

As may be appreciated, sufficient effort is required by the applicator wheel 28 rods 192 in contact with the individual carriers 14 to force the carriers 14 at their holes over the bottle caps or closures as may be seen in the partial vertical sectional view of FIG. 6 and onto the bottle necks. The rods 192 are set at circmferentially spaced distances coinciding with the spaces between the holes through which the bottle necks and caps protrude and are appropriately spaced so that simultaneously two laterally aligned carriers 14 are pressed down over the tops of the bottles. In sequence, initially, the first pair of such carriers 14 are coupled to the bottles 16 at the front of a given carton 30 as it passes through this station, then, in succeeding fashion, the last pair of carriers 14 are joined to the remaining bottles 26 of the cartons.

To insure proper lateral position of the cartons 30 with respect to the table rollers 40, appropriate vertical guide plates as at 220 may be provided, as shown in dotted lines FIG. 7. The plates 220 are supported by means of brackets as at 222 fixed to the tops of the C bars 44 supporting the rollers 40. Preferably, the guide plates 220 are laterally adjustable on the brackets 222 so that the lateral gap between these members can be widened or narrowed, depending upon the carton and bottle dimensions.

It is believed that the nature and operation of the machine is clear from the description above. However, the simplified machine or apparatus of the present invention permits simple adjustments to correlate the operation of the several components to the speed of movement of the cartons 30 of bottles 16 through the machine as fed by the endless conveyor belt 22. Preferably, the speed of the air motor 118 should be regulated by an air regulator (not shown) to permit the speed of the movement the vacuum cup arms to be is fast enough to keep a sufficient number of carriers 14 in the chute 26 when the cartons or cases 30 are moving through at maximum speed. The wheel height adjustment rod 210 is regulated by the operation of handle 216, adjusts the pressure of the applicator wheel 28 on the carriers 14. The pressure should be only enough to snap the carriers 14 downwardly onto the bottle necks as per FIG. 6. Applied positive air pressure may be applied to carriers as they start down the chute. The invention appropriately permits adjustment of the height of the discharge end of chute 26 to overt the carriers 14 properly to the top of the bottles. The chute height at this point should be approximately ¼ of an inch over the top of the bottles 16. The cam actuated vacuum release valve 153 permits release of the carriers by the suction cups 90 at the proper time in the hopper. Adjustment may be required during machine operation. The adjustment of the cam 150 should be such that there is no bounce by the carriers 14 when they hit the bottom wall 66 of the chute 26. Further, the vacuum cup arms may be adjusted so that the vacuum cups 90 hit the center of the carriers 14, i.e., the arms may be made adjustable axially relative to the shaft 100 with which they rotate.

Further, it is preferred that a microswitch 222 be employed near the top of chute 26, FIG. 1. Microswitch 222 senses the backup of carriers 14 to the supply end 26*b* of chute 26, thus acting to cut off operation of the air motor 118. Once started however, the machine operates as long as carriers 14 are supplied and the carriers 14 are removed from the gravity chute 26 automatically by the horizontal movement of the bottle filled cartons 30. Appropriately, an electrical control center as at 224, FIG. 1, may be provided for controlling the conveyor drive motor 52 and providing energization for the electrical motor driving the combined compressor/vacuum pump 126.

Further, in order to effect proper compression of the carrier down over the tops of the bottles 16 and partially down the necks of the same, heavy rubber bands 226 may be provided about the periphery of the applicator wheel 28 held by the rods 192 and spaced as desired transversely between the discs 190 forming the sides of the wheel 28. The rubber bands provide longitudinal compression force on the carriers 14 adjacent the holes 34. Care must be taken to insure that the rubber bands 226 are not aligned, however, with the holes within the carriers and the tops of the bottles to insure that the rods and bands effect proper compression of the carriers onto the bottle tops to complete a six-pack or eight-pack assembly as desired.

What is claimed is:

1. In a machine for forcibly applying a series of molded plastic carriers having at least one row of aligned holes therein to a series of upright container bottles moving along a horizontal bottle path, said machine including:

a hopper for supporting at least one stack of carriers above said bottle path, means for removing in serial fashion carriers from the bottom of said stack and feeding them along a corresponding carrier path leading from said stack of carriers and which intersects the underlying bottle movement path such that movement of said bottles causes the tops of the bottles to pull the carriers over and across the tops of the bottles passing thereunder, and an applicator wheel mounted for rotation about a horizontal axis, downstream of the intersection of the carrier path and the bottle path, and being positioned above said bottles and said carriers and means for forcibly applying said wheel into peripheral contact with said carriers to press said carriers onto the bottles to the extent that the bottle tops project through said holes, the improvement wherein:

said means for feeding said carriers along a carrier path comprises a gravity chute longitudinally aligned with said bottle path and being inclined downwardly and away from said at least on carrier stack and terminating in an open discharge end just above the tops of said bottles, and wherein said bottle path is formed by a horizontal powered conveyor means beneath said chute with its discharge end terminating upstream of the discharge end of said gravity chute and a table having a top aligned with said horizontal powered conveyor means and extending downstream therefrom from the discharge end of said horizontal powered conveyor means to a point underlying said applicator wheel, and individual open top cartons of predetermined size carrying a predetermined number of said upright bottles in row and column positions therewithin corresponding to the position and spacing of said holes within said carriers such that regardless of random movement of said cartons of bottles along said horizontal bottle path by said horizontal power conveyor means, said cartons are moved over said table beneath the discharge end of said chute and to said applicator wheel in end-to-end contact solely by the force of cartons discharging onto said table top from said powered conveyor means such that carriers are always in proper alignment with said upright bottles whereby multi-bottle carrier packs are readily assembled with carrier portions encircling the bottle necks and with the carriers embracing a selected group of container bottles.

2. The machine as claimed in claim 1, wherein said applicator wheel comprises a hollow drum having an open peripheral network including circumferentially spaced members contacting portions of said carriers on opposite sides of given carrier holes.

3. The machine as claimed in claim 2, wherein said drum comprises laterally spaced discs and a plurality of transversely extending circumferentially spaced parallel rods joined at opposite ends to respective discs and forming said open network.

4. The machine as claimed in claim 3, further comprising a plurality of longitudinally spaced rubber bands resiliently encircling said plurality of rods and being laterally spaced in conformance with the rows of holes on said carriers to effect pressing contact by said drum on the carriers at both longitudinal and lateral opposed sides of said carrier holes.

5. The machine as claimed in claim 1, further comprising means for vertically adjusting the height of the discharge end of said gravity chute relative to said table to insure proper gravity discharge of said carriers in serial fashion onto the bottles carried by said cartons.

6. The machine as claimed in claim 1, further comprising at least one keeper plate fixedly cantilever mounted adjacent the discharge end of said gravity chute and extending at a slight downward inclination in the direction of movement of said carriers, said bottles and said cartons, said keeper plate having a leading end positioned above the carriers and having a trailing end in slight pressing contact with the leading end of the carriers as they discharge onto the tops of said bottles to facilitate proper disposition of the carriers onto said bottles.

7. The machine as claimed in claim 1, wherein said means for mounting said applicator wheel for rotation about a horizontal axis comprises a pair of laterally spaced wheel support beams pivotably mounted at one end above the intersection of said carrier and bottle paths, means for mounting said applicator wheel for rotation about its axis to the opposite ends of said beams; and therebetween and said machine further comprises a threaded screw and nut adjustment wheel support means operatively carried by at least one of said pivotable wheels support beams for forcing said wheel support beams to pivot in unison about the in pivot connection at said one end and to thereby raise and lower the axis of rotation of said applicator wheel and the periphery of said wheel relative to the carriers being fed into peripheral contact therewith.

8. The machine as claimed in claim 1, wherein said hopper comprises laterally spaced vertical sidewalls and a central vertical dividing wall between said sidewalls defining side-by-side duplicate carrier stacking compartments, said chute comprises laterally spaced sidewalls and a bottom wall and being of corresponding width to said hopper and being integrally connected therewith, said chute including a vertical dividing wall intermediate of its sidewalls and forming duplicate, parallel, carrier gravity flow paths for carriers from respective stack compartments, said chute bottom wall being slotted at its upper end, a pair of vacuum cups carried by said machine and being movable about oscillating paths passing through said slots and into and out of said carrier stack compartments for contact with the bottom carriers of said stacks, and means for selectively applying vacuum pressure to said vacuum cups for causing said cups to apply suction pressure to the lowermost carriers of said stacks and adjustable spring friction means for applying frictional force against one side of each stack of carriers to prevent said carriers from leaving the hopper and entering the chute absent vacuum force application by said oscillating vacuum cups.

9. The machine as claimed in claim 8, wherein a shaft is mounted horizontally for rotation about its axis beneath said hopper, vacuum cup arms extend radially outward of said shaft and bear said vacuum cups, and power crank means is operatively coupled to said shaft for effecting oscillation of said vacuum cup arms and vacuum cups carried thereby, and said machine further comprises cam operated vacuum pressure release means operatively connected to said shaft bearing said vacuum cup arms for interrupting the application of vacuum pressure to said vacuum cups at the moment the cups removing the lowermost carrier of said stack present said lowermost carrier to the interior of said chute at the upper end thereof; whereby, release of vacuum permits the gravity movement of said carriers from the supply end of said chute towards said discharge end.

10. The machine as claimed in claim 1, wherein said gravity chute terminates in an upper end which is coupled to the bottom of said hopper, and wherein said chute open discharge end overlies said table such that said carriers slide down said chute in end-to-end abutting fashion for discharge of said carriers in proper alignment with said upright bottles of said cartons moving over said table.

* * * * *